United States Patent [19]

Commins

[11] Patent Number: 4,841,690

[45] Date of Patent: Jun. 27, 1989

[54] IMPACT NAILED CONNECTOR

[75] Inventor: Alfred D. Commins, Danville, Calif.

[73] Assignee: Simpson Strong-Tie Company, Inc., San Leandro, Calif.

[21] Appl. No.: 146,471

[22] Filed: Jan. 21, 1988

[51] Int. Cl.[4] ..... E04B 1/38

[52] U.S. Cl. ..... 52/105; 52/741; 52/712

[58] Field of Search ..... 52/702, 105, 712, 714, 52/741, 745; 403/232.1

[56] References Cited

U.S. PATENT DOCUMENTS

| | | | |
|---|---|---|---|
| 1,491,015 | 4/1924 | McFarland | 52/105 |
| 3,141,532 | 7/1964 | Runyan | 189/37 |
| 3,596,941 | 8/1971 | Tracy | 403/232.1 |
| 3,601,428 | 8/1971 | Gilb | 52/702 |
| 4,089,141 | 5/1978 | Herowx | 52/105 |
| 4,261,155 | 4/1981 | Gilb | 403/232.1 |
| 4,410,294 | 10/1983 | Gilb et al. | 52/105 |
| 4,413,456 | 11/1983 | Gilb | 52/714 |

FOREIGN PATENT DOCUMENTS

| | | | |
|---|---|---|---|
| 7314848 | 5/1975 | Netherlands | 52/702 |

OTHER PUBLICATIONS

Simpson Strong-Tie Company, Inc., 1987 Catalog entitled "Connectors for Wood Construction", Catalog C87H-1.

*Primary Examiner*—David A. Scherbel
*Assistant Examiner*—Caroline D. Dennison
*Attorney, Agent, or Firm*—James R. Cypher

[57] ABSTRACT

A sheet metal connector for wood-to-wood, metal or concrete connections between holding and held members in a building structure in which all or substantially all of the nail openings in the connector are omitted and replaced by indicia inscribed, printed, or formed in the connector at or near the locations where the nail holes were formerly punched. Fasteners, such as nails may be driven through the indicia areas of the connector and into the held and holding members by automatic nailing guns or heavy hand held impact hammers.

8 Claims, 4 Drawing Sheets

ONE 10d NAIL
DOWN 90°
UP 90°
1-10d NAIL
6
7

IMPACT NAILED CONNECTOR

BACKGROUND OF THE INVENTION

This invention relates to sheet metal connectors which use nail fasteners in joining wood framing members in building structures to other wood members or to metal or concrete members.

Specifically, the present invention relates to the construction of the sheet metal connectors so that the location points for fasteners can be located by visual or tactile feedback.

The state of the art in constructing sheet metal connectors is to form pre-punched nail openings in the connectors at the factory to indicate where the nail fasteners should be inserted through the connector. A carpenter or do-it-yourselfer attaches the connector by hammering a nail through the pre-punched openings.

The state of the art method of attaching connectors is simple, well accepted by the building trades, but swinging a hammer all day is fatiguing, and productivity slows as a result.

SUMMARY OF THE INVENTION

The gist of the present invention is the construction of sheet metal connectors by forming an indicia mark defining a nailing zone area on the connector at the factory at or near the preferred location where a fastener should be inserted through the metal connector. The connector may then be attached to either a wood, metal, or concrete member by inserting a fastener having a shank with a cross sectional area substantially smaller than the nailing zone area through the metal connector at the indicia mark by means of a nailing gun or any other device such as an impact hammer capable of forcing a nail through the sheet metal connector.

An object of the present invention is to decrease the installation time for attaching sheet metal connectors to wood, metal or concrete building members and thereby decrease the cost of building construction.

Another object is to provide a sheet metal connector which may be produced without nail holes.

A further object is to increase the load holding capacity of sheet metal connectors by decreasing the relative movement that occurs between the connector and the fastener when using sheet metal connectors with pre-punched holes which are greater in diameter than the fasteners.

A still further object is to provide a connector which is so much more efficient in installation than pre-punched connectors or connections made by toe nailing that it will increase the usage of sheet metal connectors.

Still another object is to provide greater flexibility in installatio by indicating a target area for the insertion of a nail rather than a specific preselected point.

A further object is to provide a connector which permits the fasteners to be inserted through the connector at any angle without providing specially formed nail openings in the sheet metal to guide the fasteners.

Another object is to provide a connector which carries instructions as to the size and type of fastener as well as the location of the fastener to be used.

Other phantom lines illustrate an automatic gun nailing machine for inserting nails through the metal connector and into the wood frame member.

Figure 2:
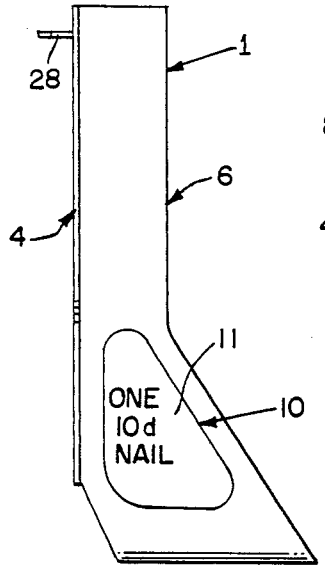
Figure 1:
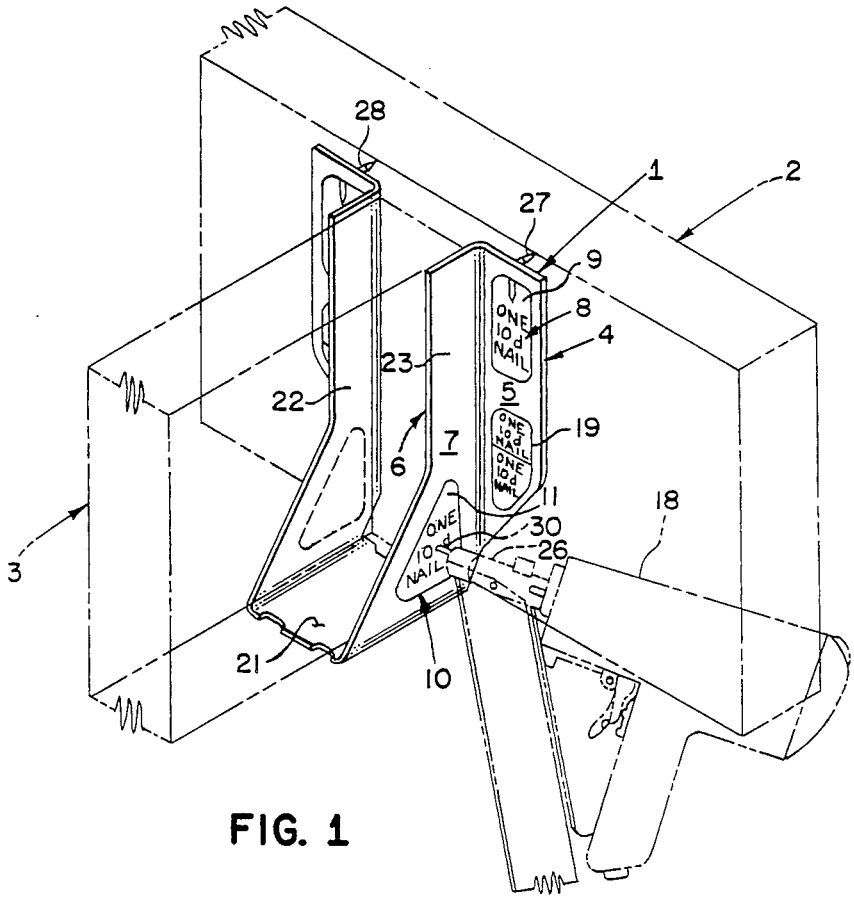
FIG. 1 is a perspective view of a typical example of a sheet metal connector which can be used in the present invention. The phantom lines indicate a typical use of a connector in joining two structural wood members.

FIG. 2 is a side elevation view of the sheet metal connector shown in FIG. 1.

Figure 3:
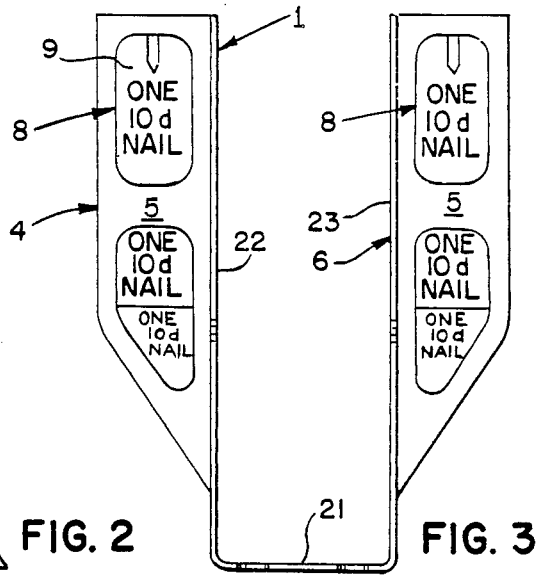

FIG. 3 is a front elevation view of the sheet metal connector shown in FIG. 1.

Figures 4, 5, 6, 7:
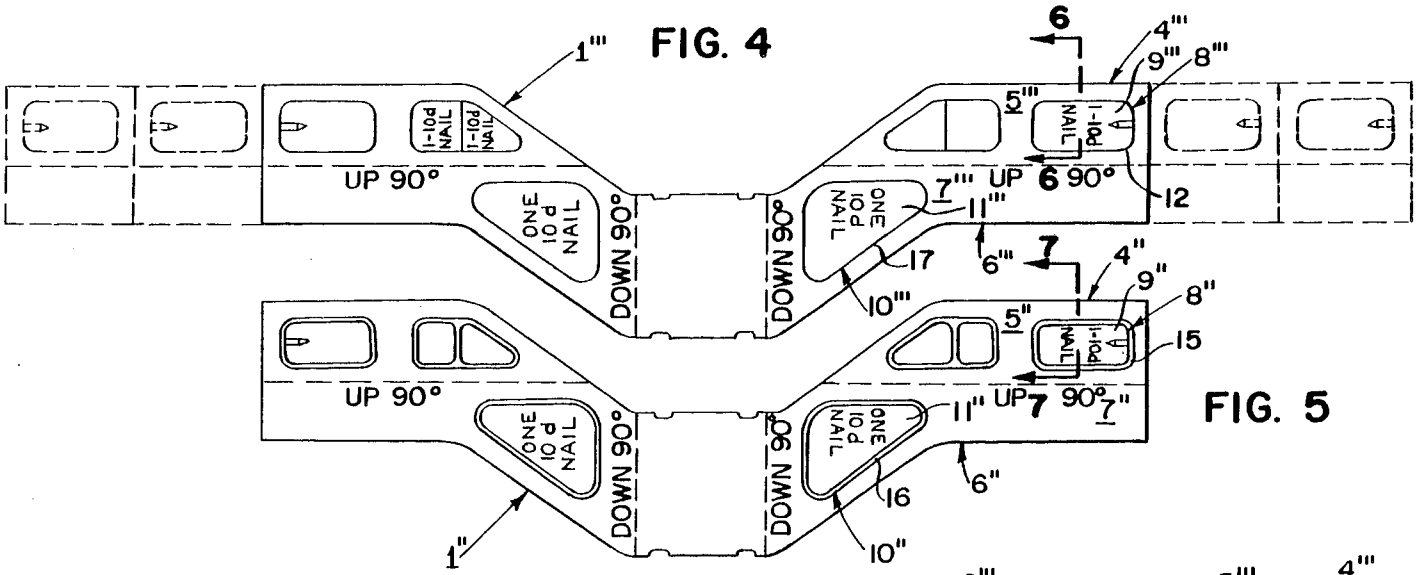

FIG. 4 is a plan view of the sheet metal connector illustrated in FIG. 1 and shown in blank form. The dashed lines indicate that different size forms of the connector can be made from the same sheet stock.

FIG. 5 is a plan view of a modified form of the sheet metal connector illustrated in FIG. 1 and shown in blank form.

FIG. 6 is a cross sectional view of a portion of the connector illustrated in FIG. 4 taken generally along line 6—6.

FIG. 7 is a cross sectional view of a portion of the modified connector illustrated in FIG. 5 taken along line 7—7.

Figure 8:
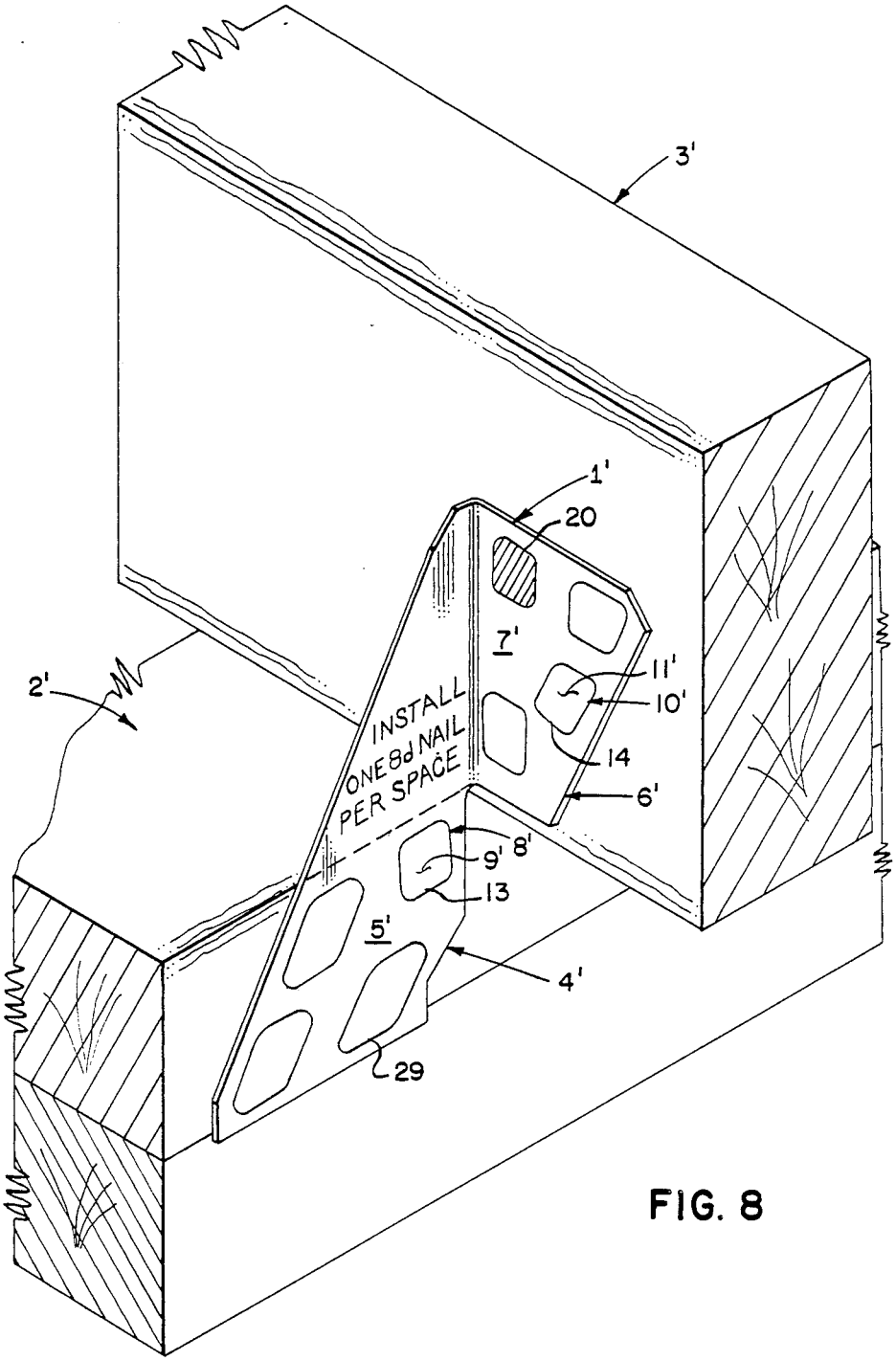

FIG. 8 is a perspective of still another form of the invention. A different type of sheet metal connector is illustrated.

Figures 9, 10, 11:
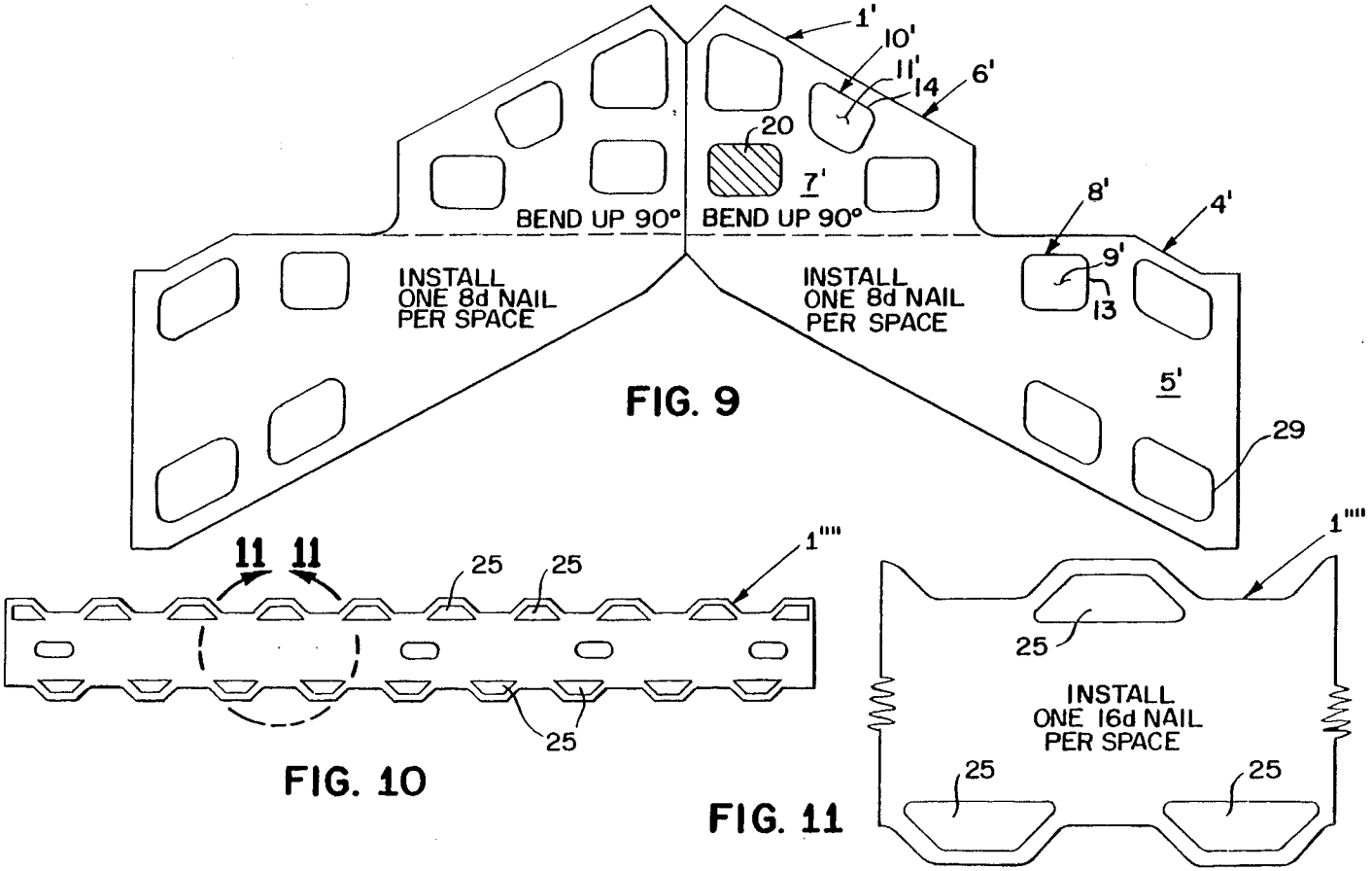

FIG. 9 is a plan view of the connector illustrated in FIG. 8 shown in blank form.

FIG. 10 is a plan view of still another type of connector with which the present invention may be used.

FIG. 11 is a plan view of a portion of the connector shown in FIG. 10 on an enlarged scale taken generally within the lines 11—11.

DESCRIPTION OF THE INVENTION

The present invention consists of a sheet metal connector 1 for wood-to-wood, metal or concrete connections between a holding member 2 and a held member 3 including: a first member 4 having a face 5 adapted for connection to the holding member 2; a second member 6 having a face 7 adapted for connection to the held member 3; non-aperture, first indicia means 8 formed in a first selected portion 9 of the face 5 of the first member 4 for targeting a fastener member for insertion therethrough into the holding member 2; and second indicia means 10 formed in a second selected portion 11 of the face of the second member 6 for targeting a fastener member such as a nail for insertion therethrough into the held member 3.

The sheet metal connector, preferably is made without any apertures for the insertion of nails, but in some connectors, it may be desirable to pre-punch nail holes in selected portions of the first member 4, the second member 6 or both.

In one form of the sheet metal connector as shown in FIGS. 4 and 6, at least one of the first or second indicia means 8''' or 10''' are inscribed in the selected portions 9''' or 11''' of the faces 5''' or 7''' of the first and second members 4''' or 6'''. The scribing may be accomplished with either a sharp scribing instrument forming a small groove 12 and 17 in the sheet metal as shown in FIGS. 4 and 6 or some other cutting method.

In another form of the invention, as shown in FIGS. 1–3, at least one of the first or second indicia means 8 or 10 are imprinted in the selected portions 9 and 11 of the faces 5 and 7 of the first and second members 4 and 6. Imprinting may be done by ink, paint or other suitable marking substance. Imprinting may consist of a simple line around the selected indicia portion 9 or 11 or multiple line cross hatching of the indicia portion.

In still another form of the invention as shown in FIG. 8, at least one of the first or second indicia means 8' or 10' are formed by indenting at least one of the selected portions 9' or 11' of the faces of the first and second members 4' or 6', forming a depressed rim 13 or 14 around the selected portion. This may be accomplished by punching a recess into the sheet metal by a hydraulic press or some other manner.

Still another sheet metal connector is illustrated in FIGS. 5 and 7 in which at least one of the first or second indicia means 8'' or 10'' are circumscribed by a raised line 15 or 16 in at least one of the selected portions 9'' or 11'' of the faces 5'' or 7'' of the first and second members 4'' or 6'' forming a raised thin line 15 or 16 around the selected portion.

Nails may be driven through the sheet metal connectors of the present invention with a heavy hammer, but the preferred method is to drive the nails using a nailing gun 18 which is standard in the industry such as nailing guns manufactured by Paslode Corporation of Lincolnshire, Ill. Nailing guns are generally operated by air pressure but a recent nailing gun offered by Paslode Corporation ignites a spark, causing a metered charge of propane to explode which drives a piston, which in turn drives the nail.

A typical nailing gun 18 is illustrated in FIG. 1 in phantom line. In order for the operator to sense the indicia means 8 and 10, the nailing gun should have either an extension member 30 connected to the nailing gun or the gun may be modified so that the nail to be driven protrudes from the nose 26 of the gun.

The shape of the indicia area may be of various geometric shapes. The shape and size should be selected by the designer of the connector and be large enough to present as large an area as possible while still maintaining the necessary edge distance of the nail from the edge of the connector, and of course, be restricted enough to suggest nailing only where the fastener will give the greatest holding strength. As seen in FIG. 1, the second indicia means 10 may be triangular, while the first indicia means 8 may have a generally rectangular shape or as indicated by number, 19, the shape may be rectangular with a sloped edge. FIG. 8 shows second indicia means 10' with a rectangular shape, but the shape may also be that of a parallelogram as shown by the number 29.

In FIGS. 10 and 11, the indica areas 25 are in the strap tie 1'''' preferably trapezoidal in shape but they could also be rectangular or even triangular.

Through long standing custom, persons installing sheetmetal connectors place a nail through every nail hole provided in the connector. When presented with a connector without nail openings, the number, size and type of nail which is preferred by the connector designer may be printed directly on the connector as illustrated in FIGS. 1–5, 8, 9 and 11.

The indicia means may be indicated by other means in addition to those noted. For example, the indicia means may be cross hatched as at 20 in FIG. 8 either by scribing, embossing or printing. When the indicia means is marked in this way, there is no need to form a raised area around the perimeter of the indicia means. The operator may either visually note the area where the nail is to be driven or if the indicia area is cross hatched by scribe or embossment means, the operator can sense the roughness of the area through a pointer 30 or protruding nail on the nailing gun.

Several forms of sheet metal connectors may be used with the present invention. It is not intended that the present system be limited to the types of connectors shown. The present system can be used with any sheet metal connector where a nailing gun or large hammer may be used to insert the nails.

FIGS. 1–3 illustrate just one of many types and sizes of joist hanger connectors that may utilize the present system. Joist hanger connectors commonly have a seat 21 which supports the held member 3 and stirrups 22 and 23 which transfer the load from the seat to side members, here indicated as the first member 4, which are attached to the holding member 2. Joist hangers are commonly used in supporting the floor joist members and attaching them to header members FIG. 5 illustrates the blank member from which the joist hanger of FIGS. 1–3 is constructed.

FIG. 4 illustrates the fact that more than one size of hanger can be made on essentially the same progressive die by simply adding extensions and using a wider coil of metal.

FIGS. 8 and 9 illustrate the use of the present invention on a connector known as a seismic and hurricane anchor 1' and is designed to provide wind and seismic ties for trusses and rafters or for general tie purposes, strongback attachments, and as all-purpose ties where one structural member crosses another. FIG. 9 illustrates the sheet metal blank from which the connector of FIG. 8 is constructed. Preferably two identical connectors are cut from a single coil on a progressive die as shown.

One of the most advantageous uses of the present invention is in connectors 1'''' known as strap ties as shown in FIGS. 10 and 11. Strap ties are made in lengths from 9 inches to 60 inches or more and require from 10 to 60 nails or more. These nails are usually **16*d* nails. The advantages of shooting 60 nails into a single strap versus nailing 60 nails with a hand hammer are obvious. The fatigue level of an installer using a hand held hammer is soon reached if the is required to constantly nail such straps with a hammer. A nail should be driven through each trapezoidal indica area, some of which are indicated by the number 25**.

In order to facilitate the installation of the connectors of the present invention, one or more prongs 27 and 28 may be formed in the connector and struck so that they protrude from the first member 4. To install, the connector prongs 27 and 28 are simply pressed or tapped into the holding member 2 in the position that the connector is to be nailed. Thus the operator may have both hands free to operate the nailing gun 18.

I claim:

1. A wood frame building connection comprising:

a. a structural holding member of wood, concrete, steel or other selected material for receiving and holding a nailing gun driven nail fastener and having a generally planar nail fastener receiving face;

b. a wood structural held member for receiving and holding a nailing gun driven nail fastener and having a generally planar nail fastener receiving face;

c. a plurality of nailing gun driven nail fasteners each having a shank with a generally uniform cross sectional area;

d. a sheet metal connector including;

1. a first member having a generally planar face positioned in face to face relation to said generally planar ail fastener receiving face of said structural holding member;

2. a second member joined to said first member having a generally planar face positioned in face to face relation to said generally planar nail fastener receiving face of said structural held member;

3. non-aperture, first indicia means formed in a first selected portion of said nail receiving face of said first member defining a nailing zone having an area substantially larger than the cross sectional area of said nailing gun driven fastener for targeting said nailing gun driven nail fastener member for insertion therethrough into said structural holding member;

4. non-aperture second indicia means formed in a second selected portion of said face of said second member defining a nailing zone having an area substantially larger than the cross sectional area of said nailing gun driven fastener for targeting said nailing gun driven nail fastener member for insertion therethrough into said structural held member;

e. at least one of said nailing gun driven nail fasteners is driven through said sheet metal connector within said nailing zone of said first member and into said structural holding member; and f. at least another one of said nailing gun driven nail fasteners is driven through said sheet metal connector within said nailing zone of said second member and into said structural held member.

2. A wood frame building connection as described in claim 1 wherein:

a. at least one of said first or second non-apertured indicia means are inscribed in said first or second selected portions of said faces of said first or second members of said sheet metal connector for defining said nailing zone.

3. A wood frame building connection as described in claim 1 wherein:

a. at least one of said first or second indicia means are imprinted on said first or second selected portions of said faces of said first and second members of said sheet metal connector for defining said nailing zone.

4. A wood frame building connection as described in claim 1 wherein:

a. at least one of said first or second indicia means are indented into at least one of said selected portions of said faces of said first or second members, of said sheet metal connector forming a rim around said selected portion defining said nailing zone.

5. A wood frame building connection as described in claim 1 wherein:

a. at least one of said first or second indicia means are circumscribed by a raised line in at least one of said selected portions of said faces of said first or second member forming a raised thin line around said selected portion defining said nailing zone.

6. The method of attaching a structural wood held member having a generally planar nail fastener receiving face to a structural wood holding member having a generally planar nail fastener receiving face which consists in:

a. selecting a plurality of nailing gun driven nail fasteners, each having a shank with a generally uniform cross sectional area;

b. selecting a sheet metal connector having a first member formed with a generally planar nail fastener receiving face having first non-apertured indicia, defining a nailing zone having an area substantially greater than said cross sectional area of said nailing gun driven nail fastener and a second member connected thereto formed with a generally planar nail fastener receiving face having second non-apertured indicia defining a nailing zone having an area substantially greater than said cross sectional area of said nailing gun driven nail fastener;

c. positioning said sheet metal connector so that said first generally planar nail fastener receiving face of said first member is in juxtaposition with said generally planar nail fastener receiving face of said structural holding member;

d. driving at least one of said nailing gun driven fasteners with a hand held nailing gun through said nailing zone area formed in said first member of said sheet metal connector into said structural holding member;

e. positioning said generally planar nail fastener receiving face of said structural held member in juxtaposition with said generally planar nail fastener receiving face of said second member of said sheet metal connector; and f. driving at least one of said nailing gun driven fasteners with a hand held nailing gun through said nailing zone area formed in said second member of said sheet metal connector into said structural held member.

7. The method of claim 6 including;

a. visually aligning a projection on said nailing gun with each of said nailing zone areas prior to driving said nailing gun driven fastener into said nailing zone areas in said sheet metal connector.

8. The method of claim 6 including;

a. tactile alignment of a projection on said nailing gun with each of said nailing zone areas prior to driving said nailing gun fasteners into said nailing zone areas in said sheet metal connector.

* * * * *